United States Patent [19]

Lockwood

[11] 4,046,283

[45] Sept. 6, 1977

[54] FINGERNAILESS TAB FOR RING-PULL CAN OPENERS

[76] Inventor: Frank J. Lockwood, 7011 W. Archer Ave., Chicago, Ill. 60638

[21] Appl. No.: 582,162

[22] Filed: May 30, 1975

[51] Int. Cl.[2] ..... B65D 41/32

[52] U.S. Cl. ..... 220/270

[58] Field of Search ..... 220/231, 269, 270, 85 CH, 220/379; 215/255, 295, 303, 305

[56] References Cited

U.S. PATENT DOCUMENTS

| | | | |
|---|---|---|---|
| 1,554,115 | 9/1925 | Miller | 215/251 |
| 3,337,085 | 8/1967 | Bozek | 220/270 |
| 3,727,790 | 4/1973 | Bly | 220/379 |

*Primary Examiner*—George T. Hall

*Attorney, Agent, or Firm*—Robert E. Wagner; Gerald T. Shekleton

[57] ABSTRACT

A novel tab for ring-pull type openers of cans containing beverages, etc., which facilitates the grasping of the ring-pull prior to bending and opening the can; an adhesive on the underside of this tab to enable the tab to be attached to the side of the can for proper disposal after the ring-pull is removed in the opening process.

5 Claims, 5 Drawing Figures

FINGERNAILESS TAB FOR RING-PULL CAN OPENERS

BACKGROUND OF THE INVENTION

The present invention relates to a device for facilitating the opening of containers while serving as a means of disposal for that device after use. More specifically, the invention relates to a ring-pull for providing openings in the tops of cans having a tab of suitable dimensions attached to facilitate the initial contact with the ring-pull for opening the can.

The ring-pull opener for cans containing such liquids as soft drinks, beer and other appropriate beverages is well known not only to those skilled in the art, but also to the consumer public at large. The typical easy-opening container has a tear portion and a ring-pull secured directly to the tear portion so that upon lifting the tab, the tear portion and tab are completely removed from the container wall. Two disadvantages may be associated with the standard ring-pull opener for cans. One of these relates to the difficulty in grasping the ring-pull for the subsequent bending and pulling to open. There are those who find it hard to grasp the standard ring-pull. Since this initial engagement is very important as a necessary first step in opening the can, this deficiency can become a severe handicap and annoyance to those people affected.

A further disadvantage of the ever-present ring-pull opener is that the ring-pull and tear portion are relatively small and are frequently carelessly discarded following their removal from the container. The container may also be discarded improperly when empty; however, because the container is relatively large, it can be easily collected for disposal. On the other hand, the ring-pull and tear portions, being quite small, are much more difficult to collect. Consequently, the separated ring-pull and tear portions are creating a litter problem, particularly at recreational areas where they become a source of danger to anyone who is barefoot. The problem is especially acute in beach areas wherein these discarded portions often lie buried in the sand. In a dangerous attempt to reduce this litter in recreational and other areas, some individuals place the ring-pull and tear portion inside the beverage can after opening. This practice is ill-advised, since there is the ever-present danger of the opener falling out of the can through the key hole and into the drinker's mouth, becoming lodged in the throat and subsequently causing, at the very least, scratched membranes in the throat and, at the most, asphyxiation, leading to death.

SUMMARY OF THE INVENTION

The present invention overcomes the above-described disadvantages of the prior ring-pull openers as described above, thus making it easier for people to open a container with a ring-pull and at the same time making a contribution to the environmental concerns of the country. This is accomplished by the attachment of a tab of about 0.001 inch thickness to the ring-pull on the opener at a point nearest the edges of the can. This tab would have adhesive of a suitable nature on that side of the fab facing the can so that, after using the tab to help lift up the ring and subsequently open the can, the tab is then pressed against either a side of the can or its bottom. Thus, when the can is thrown away in a proper receptacle, the tab is taken along with it and also disposed of properly. The placement of the pull tab on the side of the can is so convenient and easy to use, with the adhesive on the tab itself serving as a reminder to do so, in that the "sticky feeling" could not go unnoticed. Thus, by the use of the device of the present invention, the blight of the ring-pull on the landscape will soon disappear.

It is, therefore, an object of this invention to provide a method for the opening of containers.

Another object of the present invention is to facilitate the means of initially grasping the ring-pull of a container opener.

A further object of the present invention is the provision of an adequate means of disposal of the ring-pull opener after use without endangering people or the environment.

DESCRIPTION OF THE DRAWINGS

Further objects of the invention, together with additional features contributing thereto and advantages accruing therefrom, will be apparent from the following description of one embodiment of the invention when read in conjunction with the accompanying drawings wherein:

Referring now to FIG. 1, there is shown a top portion 11 of a beverage can 10 having a pull tab opener 15 which is composed of a tear-out portion 25 attached to a ring portion 20 by means of a rivet 26, and having on the ring portion 20, the subject of the present invention, a tab 30. This tab may be of paper, metal foil, plastic or other suitable material. One manner of attachment of the tab 30 to the ring 20 may be seen in FIG. 2, wherein the tab is secured in a wrap-around fashion and fused together by heat, adhesives or other suitable means. The manner of attachment is such that it results in the tab attaining an attitude as shown in FIG. 2, which attitude presents the end portion of the tab 30 at a height roughly equal to that of the rim top 40. By so doing, the consumer of the beverage or other product contained within the can, can easily grasp the tab 30 and bend the ring 20 to a position where the opening of the can 10 is an easy operation.

On the back of the tab 30 is placed an adhesive 35. This adhesive is preferably of the type commonly found on cellophane tape, cloth binding tape or bandage tape. Another form of adhesive possible would be that of the commonplace self-adhesive labels, thereby keeping the adhesive fresh by placing a protective backing over the adhesive. In this embodiment, after opening the container with the tab, the user removes the protective backing of the tab to affix the opener on the side of the container.

Figure 3:
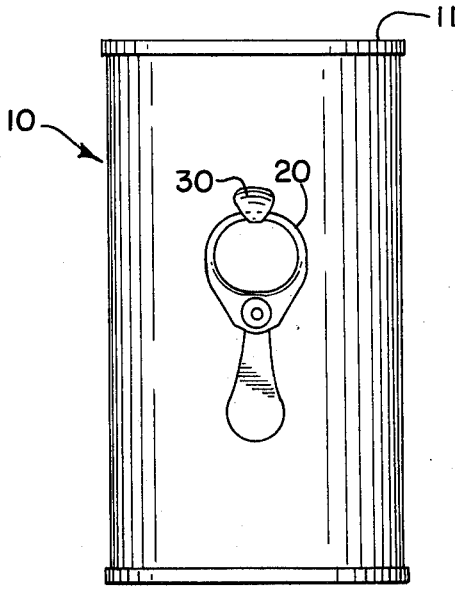
FIG. 3 is a side view of a ring-pull opener attached to the side walls of the can.

This adhesive serves a dual purpose — first, opening the can is made even easier, since the initial grasping of the tab 30 may be made by simple contact with the reverse side of the tab, and thereafter pulling. Furthermore, as shown in FIG. 3, the opener may be adhesively attached to the side of the can 10 by means of the adhesive 35 on the tab 30 after the opening is effected. As already mentioned, the use of this feature of the present invention would significantly reduce litter of this sort in all areas where beverages are consumed.

Figure 1:
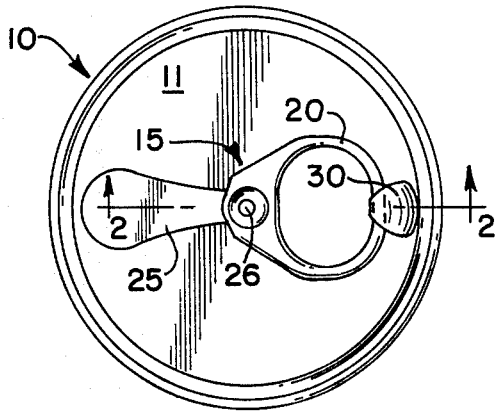
FIG. 1 is a top view of a beverage can showing one embodiment of the present invention as attached to a ring-pull opener on a can.
Figure 2:
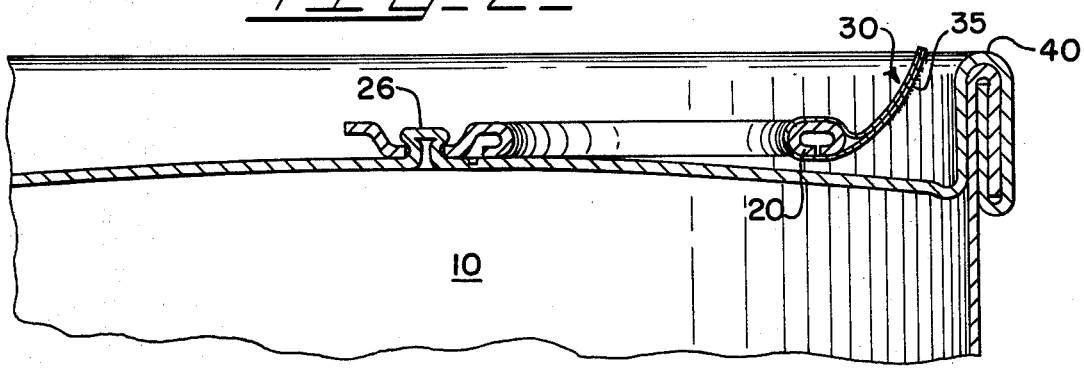
FIG. 2 is a cross section of the present invention, taken along lines 2—2 of FIG. 1 showing the top of a beverage can.
Figure 4:
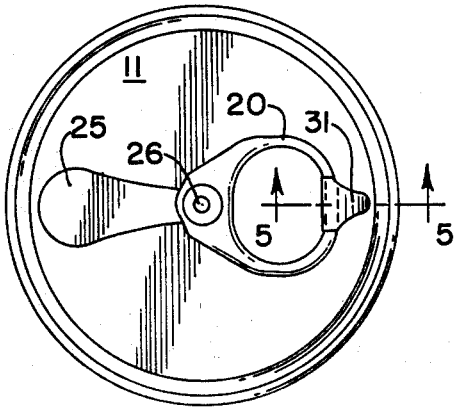
FIG. 4 is a top view of a beverage can showing another embodiment of the present invention.
Figure 5:
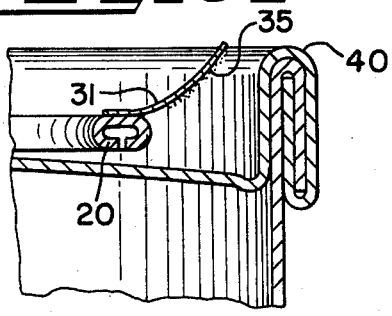
FIG. 5 is a cross section taken along lines 5—5 of FIG. 4 showing the top of a beverage can of FIG. 4.

Another embodiment of the present invention is shown in FIG. 4 where the tab 31 has a broader base and, as can be seen in FIG. 5, is attached to the ring 20 by a suitable adhesive or other means. While such a manner of attachment requires less material for the tab than that shown in FIGS. 1 and 2, a stronger bond to the ring 20, to overcome the inherent structural weakness associated with the smaller contact area, is necessary. Otherwise the tab 31 would tend to tear and become dissociated from the ring 20 when opening the can. It is also intended as within the scope of this invention that the tab might be an integral part of the ring, thereby being of the same material, and inherently stronger.

While the fingernailess tab has been described with reference to a preferred embodiment, it will be understood by those skilled in the art that various changes may be made and equivalents may be substituted for elements of the fingernailess tab without departing from the scope of the invention. In addition, many modifications may be made to adapt a particular situation or material to the teachings of the invention without departing from the essential scope thereof. Therefore, it is intended that the fingernailess tab not be limited to the particular embodiment disclosed as the best mode contemplated for carrying out this invention, but that the invention will include all embodiments falling within the scope of the appended claims.

I claim:

1. A ring-pull opener for a can containing beverages and the like comprising a cover having a tear portion and a ring attached to said tear portion, a flexible upstanding tab attached to said ring at a point on said ring diametrically opposed to said tear portion and at an acute angle to said cover to permit said tab to be easily grasped to elevate said ring, whereby said ring may be grasped to open said can, said tab having an adhesive on the one side thereof, said adhesive permitting said ring and tear portion upon removal from said can to be adhesively secured to any desired portion of said can to maintain the ring tear portion and can together for ease of disposal.

2. The ring-pull opener of claim 1 whereby said tab has a removale protective cover on said adhesive, said cover retaining the adhesive properties of said tab until removed.

3. The ring-pull opener of claim 1 whereby said adhesive is on the side of said tab facing said cover, a portion of said tab thereby adhering to said cover, said adhesive being exposed in lifting said ring, the adherence of said tab to said cover retaining the adhesive properties of said tab until use of the ring-pull opener.

4. The ring-pull opener of claim 1 wherein said tab is formed of any one of paper, metal or plastic.

5. The ring-pull opener of claim 1 wherein said tab is integrally attached to said ring.

* * * * *